US008585165B2

(12) United States Patent
Liang et al.

(10) Patent No.: US 8,585,165 B2
(45) Date of Patent: Nov. 19, 2013

(54) DEVICE FOR ADJUSTING HEIGHT OF DRAWER

(75) Inventors: Hsiu-Chiang Liang, Kaohsiung Hsien (TW); Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 351 days.

(21) Appl. No.: 13/005,025

(22) Filed: Jan. 12, 2011

(65) Prior Publication Data

US 2012/0176015 A1 Jul. 12, 2012

(51) Int. Cl.
*A47B 88/04* (2006.01)

(52) U.S. Cl.
USPC ..... 312/334.4; 312/330.1

(58) Field of Classification Search
USPC ..... 312/333, 330.1, 334.1, 334.4, 334.5, 312/334.27, 334.32, 351
See application file for complete search history.

(56) References Cited

U.S. PATENT DOCUMENTS

| | | | | |
|---|---|---|---|---|
| 5,375,922 | A * | 12/1994 | Brustle et al. | 312/334.4 |
| 5,664,855 | A * | 9/1997 | Lautenschlager et al. | 312/334.4 |
| 7,014,282 | B2 | 3/2006 | Hammerle | |
| 8,052,234 | B2 * | 11/2011 | Liang et al. | 312/334.4 |
| 2009/0167128 | A1 | 7/2009 | Berger | |

* cited by examiner

*Primary Examiner* — James O Hansen
(74) *Attorney, Agent, or Firm* — Rosenberg, Klein & Lee

(57) ABSTRACT

A device for adjusting height of a drawer is disposed on the drawer and a rear portion of a guide rail. The device includes a base, a supporting seat, an adjusting member, a screw rod and a connecting member. A first end of the base is connected to the guide rail and the supporting seat is mounted on the second end of the base. The screw rod is connected to the adjusting member and extends through the supporting seat. The screw rod is also connected to the guide rail. The connecting member is connected to the drawer and has a pin. When the drawer is mounted on the guide rail, the pin is connected to the supporting seat. When the adjusting member is rotated, the supporting seat and the connecting member are movable, so that the height of the drawer relative to the guide rail can be adjusted.

8 Claims, 8 Drawing Sheets

DEVICE FOR ADJUSTING HEIGHT OF DRAWER

FIELD OF THE INVENTION

The present invention relates to a device for adjusting height of a drawer, and more particularly, to a device connected with a guide rail to adjust the height of the rear end of the drawer relative to the guide rail.

BACKGROUND OF THE INVENTION

U.S. Pat. No. 7,014,282 to Haemmerle discloses a "pull-out guide for drawers" which is able to adjust the rear height of the drawer. However, it needs to use a screw driver or an eccentric member of the device to operate.

U.S. Patent Application Pub. No. 2009/0167128 to Berger discloses a "device for adjustable mounting of the runner of pull-out guides on drawers" which is also related to a device for adjusting the rear height of the drawer. The disclosure of one embodiment of Berger comprises a drawer 10 connected to a runner 18 and a receiving component 56 is inserted into the rear end of the drawer. The receiving component has a receiving opening 66. A mounting element 22 includes a lever arm 24 which has a bearing journal 26 pivotably connected to a side of the runner. The lever arm includes a hole 30 and a plate 28, the plate is engaged with the receiving opening. A disc-shaped plate 44 has a lever 52 and an eccentric component 32, the disc-shaped plate is connected to the mounting element by a bearing component 40. The eccentric component is engaged with the hole of the mounting element. By the arrangement, when the lever is rotated, the eccentric component rotates the mounting element about the bearing journal, so that the plate of the mounting element drives the receiving component and the height of the rear end of the drawer can be adjusted.

The disclosure is helpful in adjusting the height of the drawers when assembling the furniture and improves the angular positioning of the drawer when installed to the furniture. Nevertheless, when operating the above disclosed devices, the use of a screw driver is not convenient for the users. When using the eccentric component to adjust the height, the adjustment is very limited. There is still room to be improved.

SUMMARY OF THE INVENTION

The present invention intends to provide a device for adjusting height of a drawer, and the device is operated without using any tool and too much force.

The present invention relates to a device for adjusting height of a drawer, and comprises a drawer having an engaging recess in the rear end thereof. The drawer is connected with a guide rail. A base has a first end and a second end which is located in opposite to the first end. The first end is connected to the guide rail. The base has flexibility so that the second end is deformed relative to the first end. When the second end is higher than the first end, an inclined guiding surface is formed between the first and second ends. A supporting seat is connected to the second end of the base and includes an upright hole, a transverse hole which communicates with the upright hole, and a supporting hole. An adjusting member is located in the transverse hole of the supporting seat and includes a threaded hole which is located corresponding to the upright hole of the supporting seat. The adjusting member has an adjusting portion which is exposed from the transverse hole of the supporting seat. A screw rod extends through the upright hole of the supporting seat and is connected to the threaded hole of the adjusting member and the guide rail. A connecting member includes a protrusion and a pin respectively extending from two opposite sides of a fixing board. The protrusion is engaged with the engaging recess of the drawer and the pin is inserted in the supporting hole of the supporting seat.

Preferably, the engaging recess of the drawer is a circular recess and the protrusion of the connecting member is a cylindrical rod.

Preferably, the engaging recess of the drawer is an elongate groove and the protrusion of the connecting member is an elongate block.

Preferably, the base includes two sidewalls located between the first and second ends thereof, and two positioning portions. Each positioning portion has a fixing plate. The supporting seat includes two reception portions and each reception portion has a fixing hole. The fixing plates of the positioning portions are respectively inserted into the fixing holes of the reception portions.

Preferably, the first end of the base includes holes and the guide rail includes bosses which are riveted to the holes.

Preferably, the first end of the base is inserted into a slot of the guide rail to connect to each other.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
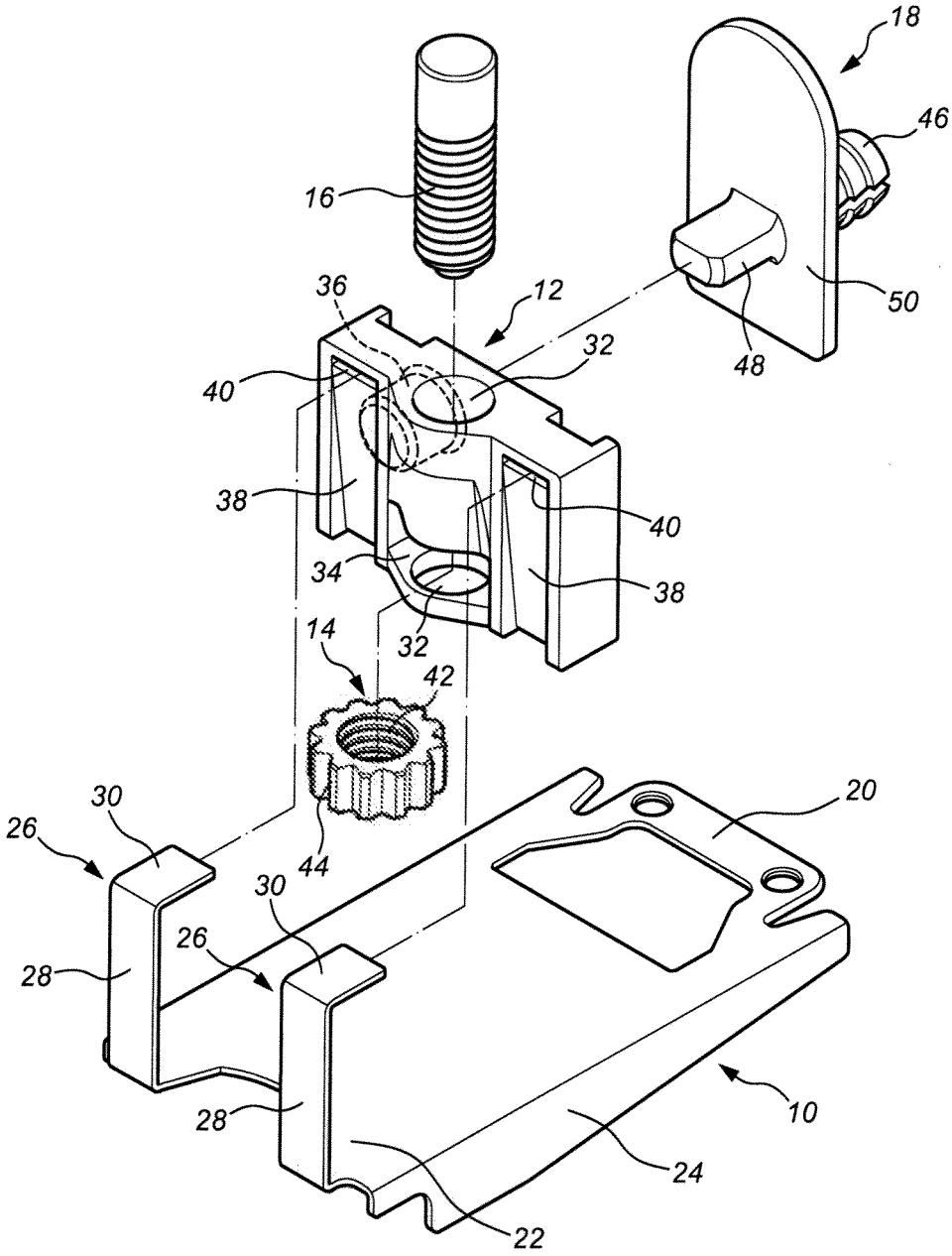
FIG. 1 is an exploded view to show the device for adjusting height of a drawer of a preferred embodiment of the present invention.

Referring to FIG. 1, the device for adjusting height of a drawer of the present invention comprises a base 10, a supporting seat 12, an adjusting member 14, a screw rod 16 and a connecting member 18.

The base 10 is made of a flexible material such as a metal plate and includes a first end 20 and a second end 22 which is located in opposite to the first end 20. Two sidewalls 24 extend downward from two opposite sides between the first and second ends 20, 22 of the base 10. Two positioning portions 26 each have a vertical section 28 extending upward form the second end 22, and each vertical section 28 has a fixing plate 30 extending perpendicularly therefrom and toward the first end 20.

The supporting seat 12 is connected to the second end 22 of the base 10 and includes an upright hole 32, a transverse hole 34 which communicates with the upright hole 32, and a supporting hole 36 to which the connection member 18 is connected. The supporting seat 12 has two reception portions 38 and each reception portion 38 has a fixing hole 40. The fixing plates 30 of the positioning portions 26 of the base 10 are respectively inserted into the fixing holes 40 of the reception portions 38.

The adjusting member 14 is located in the transverse hole 34 of the supporting seat 12 and includes a threaded hole 42 located corresponding to the upright hole 32 of the supporting seat 12. The adjusting member 14 further has an adjusting portion 44 which is exposed from the transverse hole 34 of the supporting seat 12 so that the user can operate the adjusting member 14.

The screw rod 16 extends through the upright hole 32 of the supporting seat 12 and is connected to the threaded hole 42 of the adjusting member 14.

Figure 2:
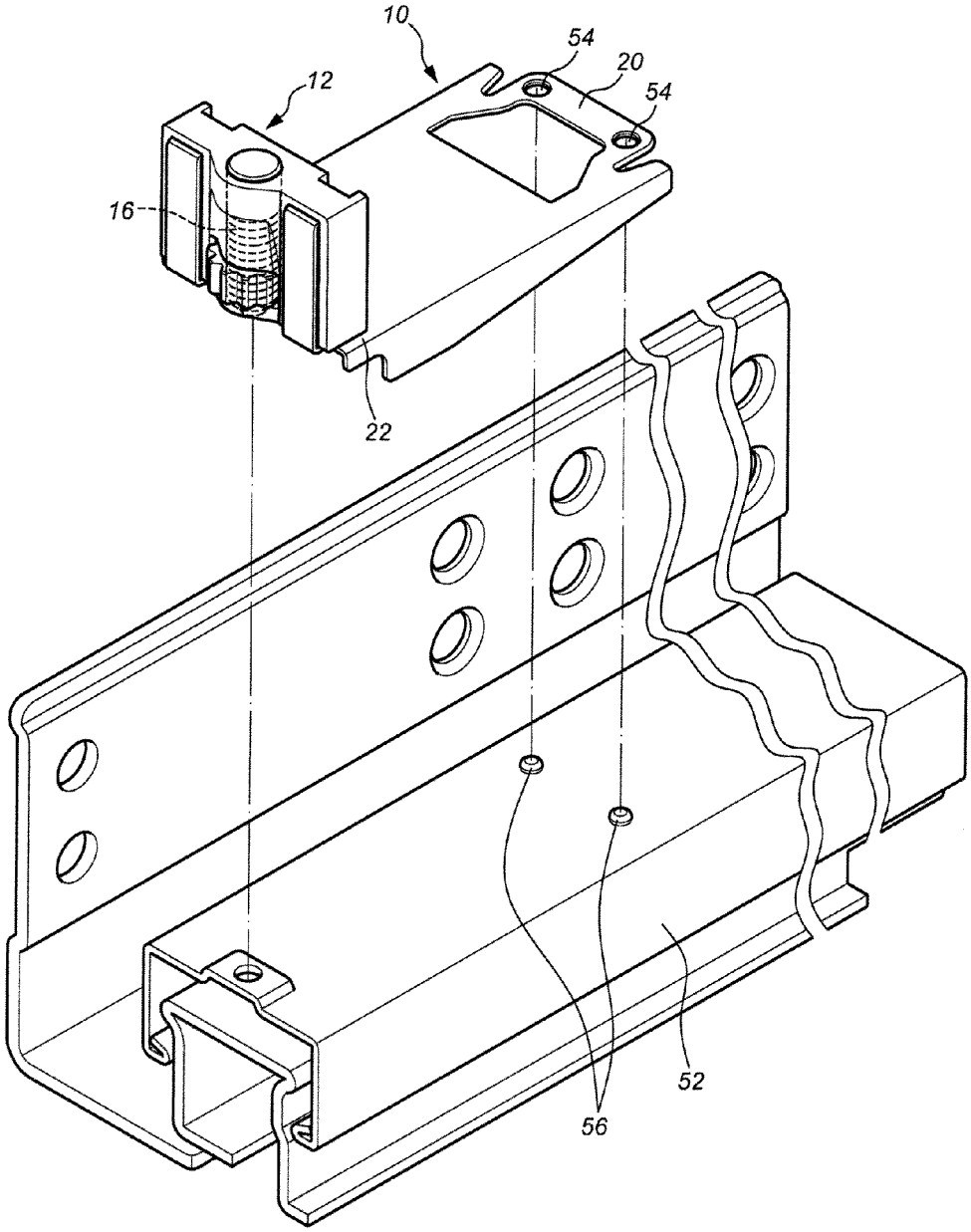
FIG. 2 shows the device for adjusting height of a drawer of the preferred embodiment of the present invention is to be connected with a guide rail.
Figure 3:
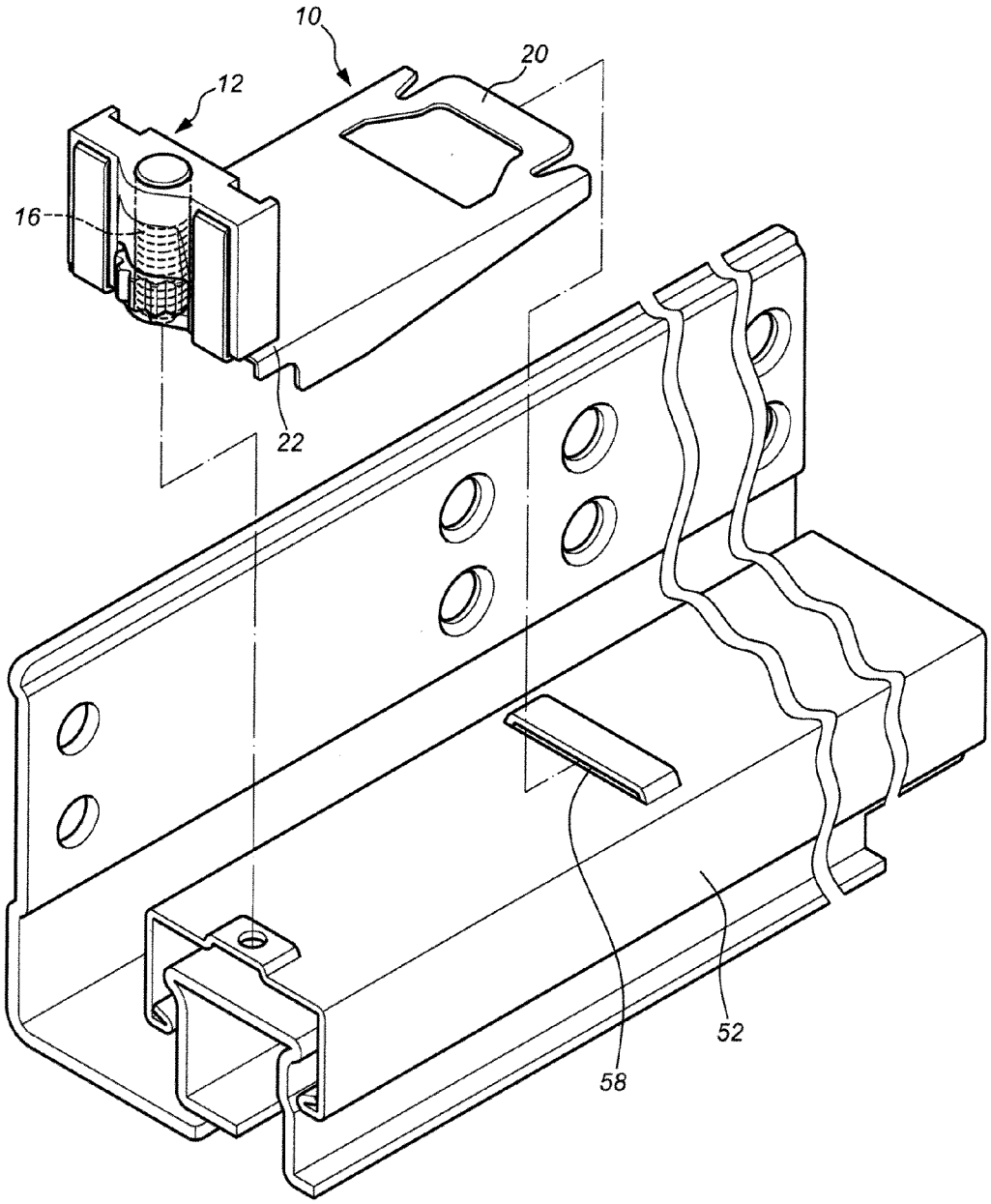
FIG. 3 shows another embodiment of the device for adjusting height of a drawer of the present invention to be connected with a guide rail.

The connecting member 18 includes a protrusion 46 and a pin 48 respectively extending from two opposite sides of a fixing board 50, When using the device, the device is connected to a guide rail 52. The first end 20 of the base 10 is connected to the rear portion of the guide rail 52 by way of riveting, welding or any known method. For example, as shown in FIG. 2, the first end 20 includes holes 54 and the guide rail 52 includes bosses 56 which are riveted to the holes 54. Alternatively, as shown in FIG. 3, the first end 20 of the base 10 is inserted into a slot 58 of the guide rail 52 to connect to each other. The second end 22 of the base 10 is indirectly connected to the guide rail 52 by the supporting seat 12 and the screw rod 16, wherein the screw rod 16 has one end connected to the guide rail 52.

When a drawer 60 is installed to the guide rail 52, the underside of the drawer 60 is connected on two guide rails 52 and two height adjusting devices are respectively connected to the rear end 70 of the drawer 60 and the two guide rails 52.

Figure 4:
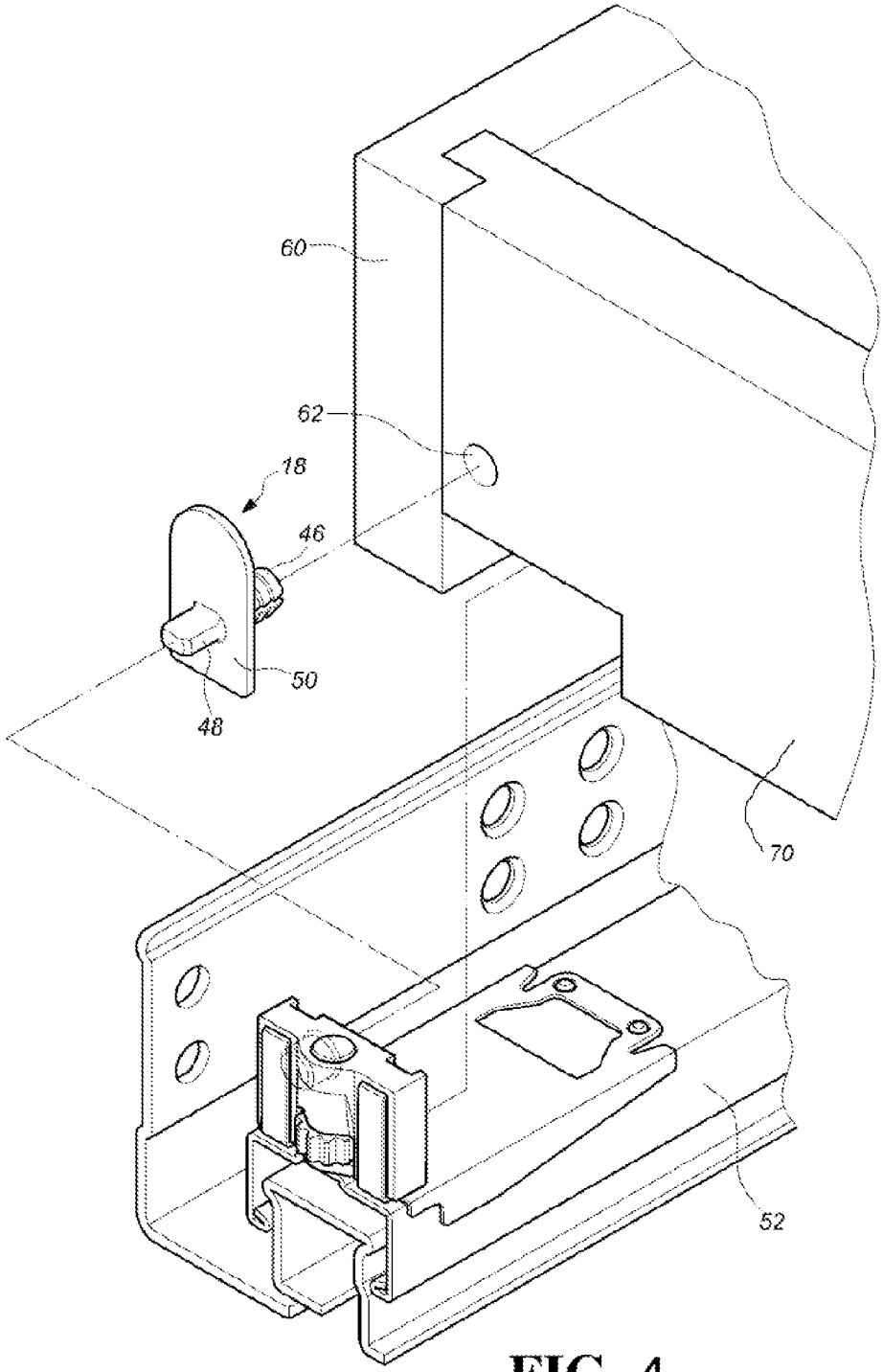
FIG. 4 shows the device for adjusting height of a drawer of the preferred embodiment of the present invention is to be connected with a guide rail and one side of a drawer.
Figure 5:
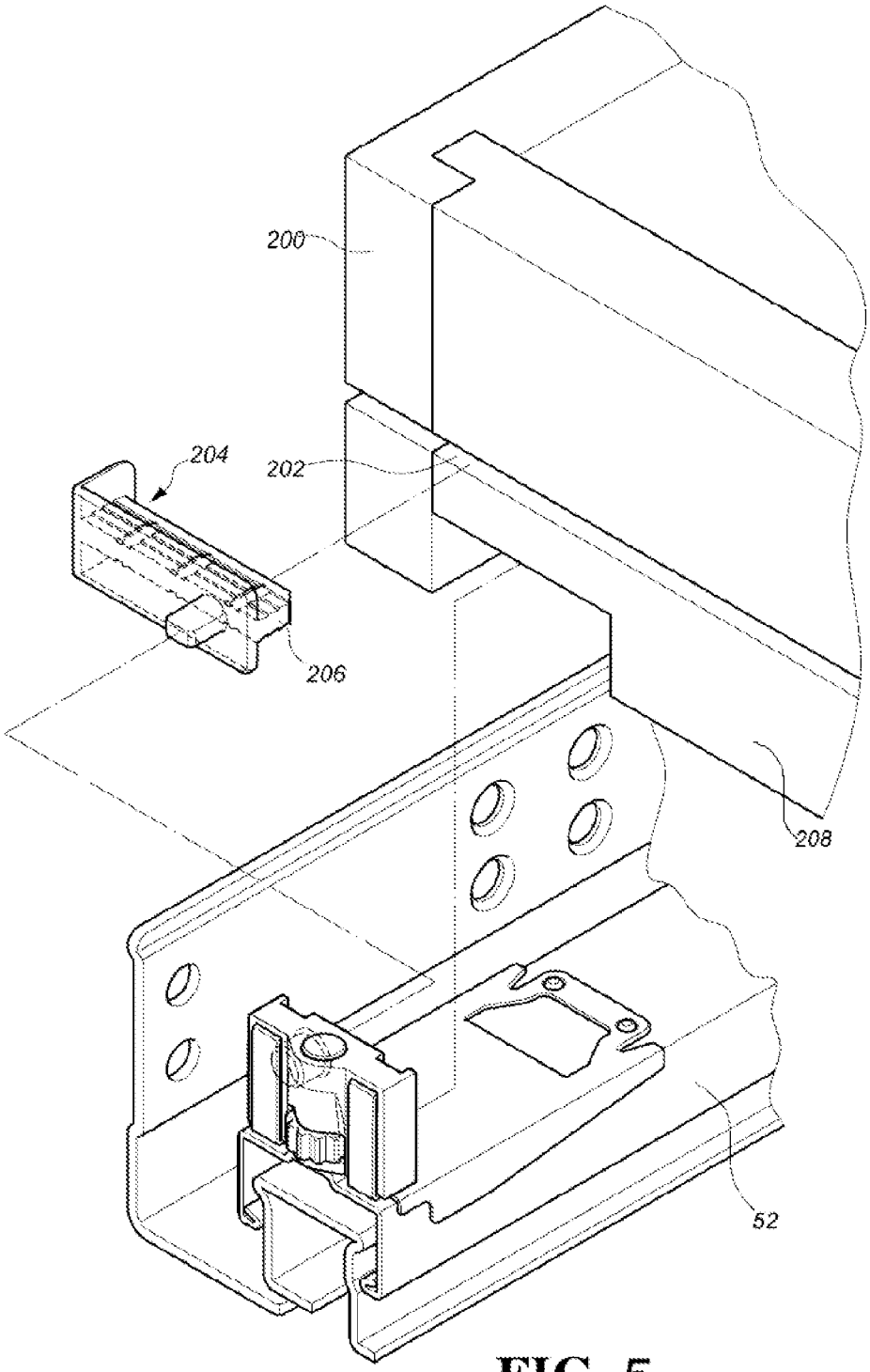
FIG. 5 shows another embodiment of the device for adjusting height of a drawer of the present invention which is to be connected with a guide rail and one side of a drawer.

FIG. 4 shows only one side of the drawer, one guide rail and one device of the present invention. The drawer includes an engaging recess 62 in the rear end 70 thereof. The engaging recess 62 of the drawer 60 is a circular recess and the protrusion 46 of the connecting member 18 is a cylindrical rod. The protrusion 46 of the connecting member 18 is engaged with the engaging recess 62 of the drawer 60. Alternatively, as shown in FIG. 5, the engaging recess 202 of the drawer 200 is an elongate groove in the rear end 208 of the drawer 200 and the protrusion 206 of the connecting member 204 is an elongate block which is engaged with the engaging recess 202.

Figure 6:
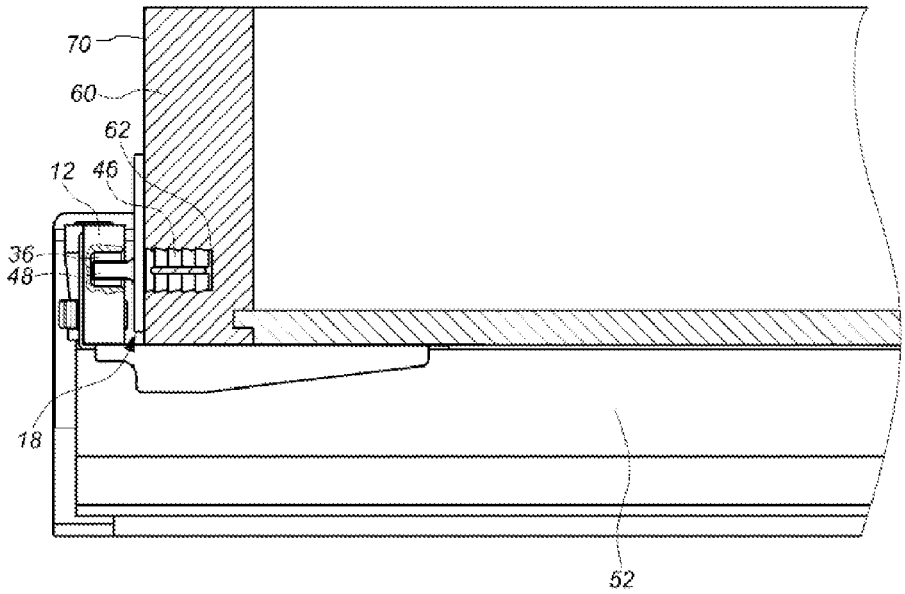
FIG. 6 shows the device for adjusting height of a drawer of the preferred embodiment of the present invention connected with a guide rail to which a drawer is connected.
Figure 7:
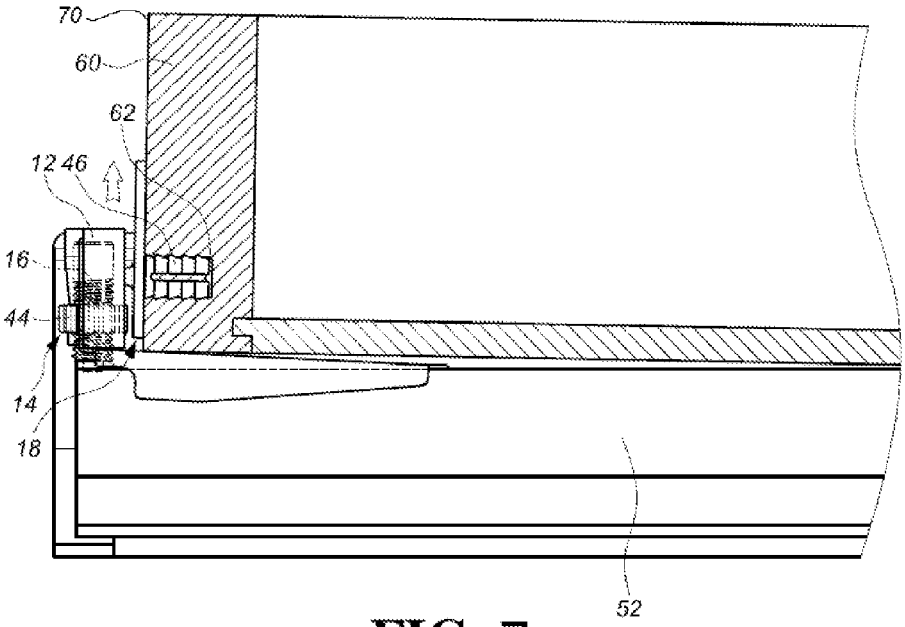
FIG. 7 shows that the height of the drawer is adjusted relative to the guide rail by the device for adjusting height of a drawer of the preferred embodiment of the present invention.

When the drawer 60 is connected to the guide rail 52 with the device of the present invention, as shown in FIG. 6, the protrusion 46 of the connecting member 18 is engaged with the engaging recess 62 of the drawer 60, and the pin 48 is inserted into the supporting hole 36 of the supporting seat 12. When adjusting the height of the drawer 60 to correct the inclination, as shown in FIG. 7, the user rotates the adjusting portion 44 of the adjusting member 14, the adjusting member 14 is rotated relative to the screw rod 16 and drives the supporting seat 12 to shift. The supporting seat 12 moves the connecting member 18 to adjust the rear end 70 of the drawer 60 relative to the guide rail 52. By this way, the drawer 60 can be properly adjusted to its optimal status.

Figure 8:
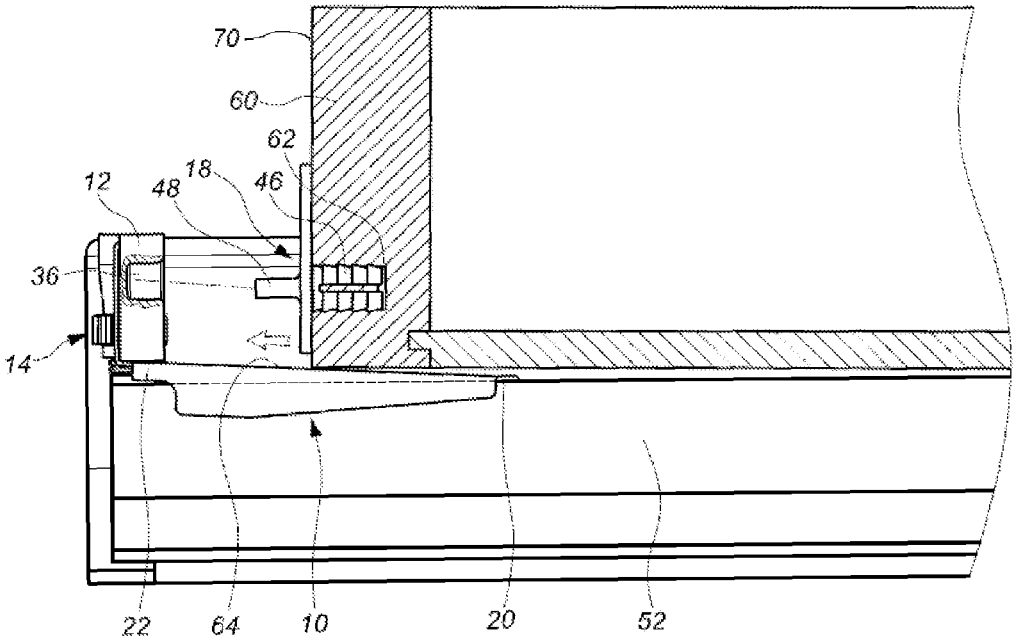
FIG. 8 shows that an inclined guiding surface is formed in the device for adjusting height of a drawer of the preferred embodiment of the present invention so as to guide the drawer to be connected to the guide rail.

As shown in FIG. 8, when the supporting seat 12 is adjusted to away from the guide rail 52 by the adjusting member 14, the second end 22 of the base 10 is moved and higher than the first end 20. An inclined guiding surface 64 is formed between the first and second ends 20, 22. By the inclined guiding surface 64, when the drawer is removed from the guide rail 52 and re-installed again, the rear end of the drawer 60 can be guided by the inclined guiding surface 64 and raises to allow the pin 48 of the connecting member 18 to be inserted into the supporting hole 36 of the supporting seat 12.

Figure 9:
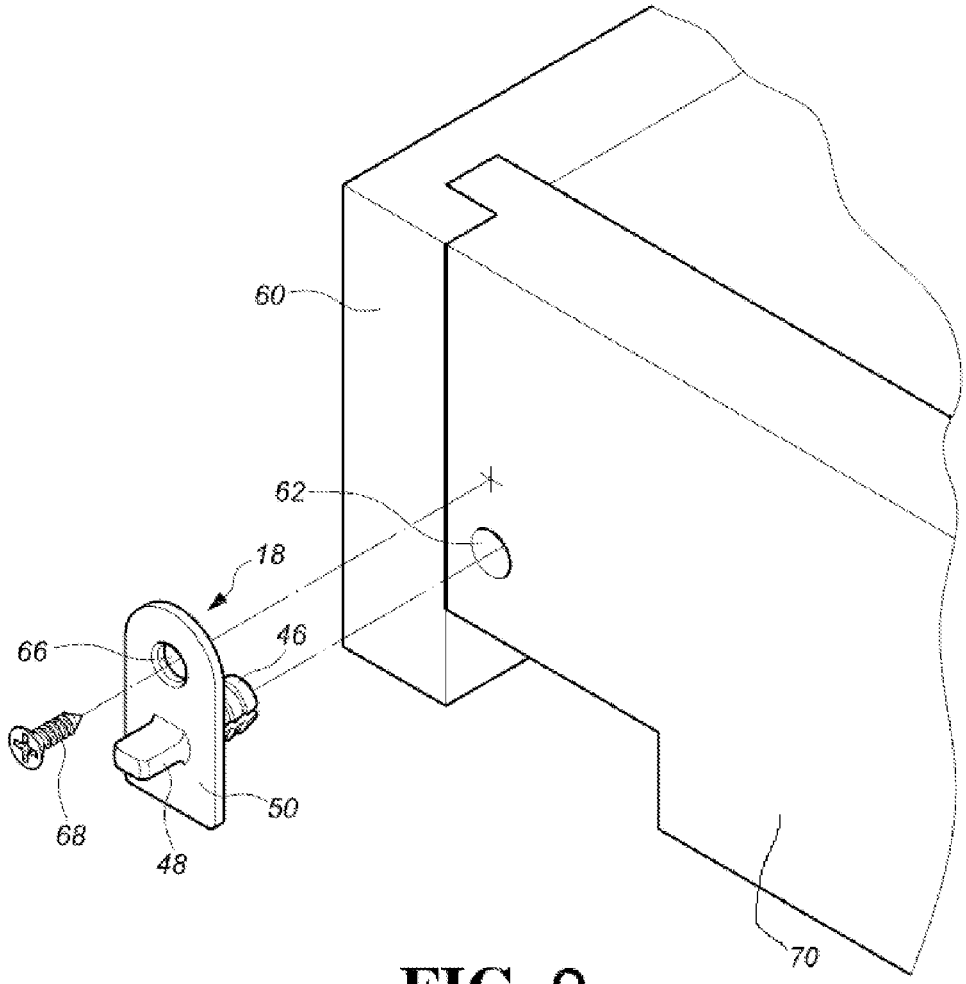
FIG. 9 shows the connection between the connecting member and the drawer is made by a fixing member.

As shown in FIG. 9, for the connection of the connecting member 18 and the drawer 60, in one embodiment, preferably, the fixing board 50 of the connecting member 18 has a fixing hole 66, and a fixing member 68, such as a bolt, extends through the fixing hole 66 and is connected to the drawer 60. An extra connecting force is provided by the bolt.

While we have shown and described the embodiment in accordance with the present invention, it should be clear to those skilled in the art that further embodiments may be made without departing from the scope of the present invention.

What is claimed is:

1. A device for adjusting height of a drawer, comprising:

the drawer having a rear end which includes an engaging recess, the drawer connected with a guide rail;

a base having a first end and a second end which is located in opposite to the first end, the first end connected to the guide rail, the base having flexibility and the second end being deformed relative to the first end, wherein when the second end is higher than the first end, an inclined guiding surface is formed between the first and second ends;

a supporting seat connected to the second end of the base, the supporting seat including an upright hole, a transverse hole which communicates with the upright hole, and a supporting hole;

an adjusting member located in the transverse hole of the supporting seat, the adjusting member including a threaded hole located corresponding to the upright hole of the supporting seat, the adjusting member having an adjusting portion which is exposed from the transverse hole of the supporting seat;

a screw rod extending through the upright hole of the supporting seat and the threaded hole of the adjusting member and connected to the guide rail, and a connecting member including a protrusion and a pin respectively extending from two opposite sides of a fixing board, the protrusion engaged with the engaging recess of the drawer and the pin inserted in the supporting hole of the supporting seat, wherein the base includes two sidewalls located between the first and second ends thereof and two positioning portions, each of the positioning portions has a fixing plate, the supporting seat includes two reception portions and each of the reception portions has a fixing hole, the fixing plates of the positioning portions are respectively inserted into the fixing holes of the reception portions.

2. The device as claimed in claim 1, wherein the engaging recess of the drawer is a circular recess and the protrusion of the connecting member is a cylindrical rod.

3. The device as claimed in claim 1, wherein the engaging recess of the drawer is an elongate groove and the protrusion of the connecting member is an elongate block.

4. The device as claimed in claim 1, wherein the first end of the base includes holes and the guide rail includes bosses which are riveted to the holes.

5. The device as claimed in claim 1, wherein the first end of the base is inserted into a slot of the guide rail to connect to each other.

6. A device for adjusting height of a drawer, comprising:

the drawer having a rear end which includes an engaging recess, the drawer connected with a guide rail;

a base having a first end and a second end which is located in opposite to the first end, the first end connected to the guide rail, the base having flexibility and the second end being deformed relative to the first end, wherein when the second end is higher than the first end, an inclined guiding surface is formed between the first and second ends;

a supporting seat connected to the second end of the base, the supporting seat including an upright hole, a transverse hole which communicates with the upright hole, and a supporting hole;

an adjusting member located in the transverse hole of the supporting seat, the adjusting member including a threaded hole located corresponding to the upright hole of the supporting seat, the adjusting member having an adjusting portion which is exposed from the transverse hole of the supporting seat;

a screw rod extending through the upright hole of the supporting seat and the threaded hole of the adjusting member and connected to the guide rail, and a connecting member including a protrusion and a pin respectively extending from two opposite sides of a fixing board, the protrusion engaged with the engaging recess of the drawer and the pin inserted in the supporting hole of the supporting seat, wherein the first end of the base includes holes and the guide rail includes bosses which are riveted to the holes.

7. The device as claimed in claim 6, wherein the engaging recess of the drawer is a circular recess and the protrusion of the connecting member is a cylindrical rod.

8. The device as claimed in claim 6, wherein the base includes two sidewalls located between the first and second ends thereof and two positioning portions, each of the positioning portions has a fixing plate, the supporting seat includes two reception portions and each of the reception portions has a fixing hole, the fixing plates of the positioning portions are respectively inserted into the fixing holes of the reception portions.

* * * * *